US006892551B2

(12) United States Patent
Gunji et al.

(10) Patent No.: US 6,892,551 B2
(45) Date of Patent: May 17, 2005

(54) AIR CONDITIONER

(75) Inventors: Yoshihiro Gunji, Kawasaki (JP); Yukihiko Imai, Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 10/665,512

(22) Filed: Sep. 22, 2003

(65) Prior Publication Data

US 2004/0060314 A1 Apr. 1, 2004

(30) Foreign Application Priority Data

Sep. 26, 2002 (JP) ..... 2002-280445
Sep. 30, 2002 (JP) ..... 2002-287037

(51) Int. Cl.[7] ..... F25D 23/12; F25D 21/14; F25B 47/00

(52) U.S. Cl. ..... 62/262; 62/263; 62/280; 62/285

(58) Field of Search ..... 62/262, 263, 280, 62/285, 259.1

(56) References Cited

FOREIGN PATENT DOCUMENTS

| | | | | |
|---|---|---|---|---|
| JP | 62217029 A | * | 9/1987 | ..... F24F/1/00 |
| JP | 63049644 A | * | 3/1988 | ..... F24F/1/00 |
| JP | 09145149 A | * | 6/1997 | ..... F24F/13/32 |

* cited by examiner

*Primary Examiner*—Chen Wen Jiang
(74) *Attorney, Agent, or Firm*—Manabu Kanesaka

(57) ABSTRACT

In order to provide an air conditioner capable of safely discharging drain water outwards, and having good assembly properties and maintenance properties, an electrical equipment box 270 including a control substrate is placed on the side of a first side plate 250 of a base panel 200, and a drain pump unit 600 is placed adjacent to a second side plate 260, to treat drain water in a position apart from an electrical system.

10 Claims, 7 Drawing Sheets

AIR CONDITIONER

TECHNICAL FIELD

The present invention relates to a wall-hung air conditioner, and more particularly to an air conditioner capable of safely discharging drain water outwards without adversely affecting electrical equipment, and having good assembly properties and maintenance properties.

BACKGROUND ART

When an air conditioner (an indoor device) is operated in a cooling mode, moisture in the air is condensed to produce drain water in a heat exchanger provided therein. Generally, the drain water is received by a drain pan provided in a body cabinet, and discharged outdoors via a drain hose connected to a part of the drain pan.

A large amount of drain water is produced particularly in hot and humid areas such as coastal areas or Southeast Asia. Thus, some air conditioners are suggested such that a pump for discharging drain water is provided in a body cabinet to force the drain water out.

Japanese Patent Application publication No. 2002-130722 (related example 1) is an example. The example 1 describes that an air conditioner has a drain pump placed in a space formed between a fan body of a cross flow fan and a motor, provided in a body cabinet. Thereby, the need for a dedicated space for the drain pump is eliminated to save space, as one advantage.

On the other hand, when a drain pump is used, vibration of a pump motor therein may produce resonance together with a body cabinet to cause abnormal sounds. Japanese Patent Application publication No. 8-285305 (related example 2) is an example to solve the above problem. The example 2 describes that a drain pump is mounted to a body cabinet via a rubber isolator. Thereby, vibration of the drain pump is absorbed by the rubber isolator to effectively minimize abnormal sounds.

However, the method of the example 1 has the following problems. Specifically, the drain pump is placed near the motor of the cross flow fan or an electric part such as an electrical equipment box, and there is a risk of electrical leakage caused by drain water.

Further, the drain pump is placed on the back of an output shaft of the motor, and in order to remove the drain pump, the cross flow fan and a heat exchanger unit covering the fan must be removed, thus offering poor maintenance properties.

The method of the example 2 includes a cap-like rubber isolator covering a movable portion such as a pump motor, and is thus suitable for minimizing local vibration, but less effective against vibration caused by three-dimensional rotational motion.

SUMMARY OF THE INVENTION

The invention is made to solve the above described problems, and has an object to provide an air conditioner capable of safely discharging drain water outwards, and having good assembly properties and maintenance properties.

In order to achieve the object, the invention provides an air conditioner including: a body cabinet that includes a base panel secured to an indoor wall surface via predetermined securing means, the base panel having first and second side plates that support a cross flow fan and a heat exchanger from both sides; a drain pan that receives drain water produced by the heat exchanger; and a drain pump unit that discharges the drain water collected by the drain pan outwards of the body cabinet, wherein an electrical equipment box including a control substrate is placed adjacent to the first side plate of the base panel, and the drain pump unit is placed adjacent to the second side plate. Thereby, the drain pump unit is placed opposite the electrical equipment with the heat exchanger therebetween, thus reliably preventing electrical leakage of the electrical equipment caused by drain water. Further, the electrical equipment is housed in an opposite space, thus increasing maintenance properties.

The drain pan has a drain passage formed into a trough shape along the heat exchanger, and a drain tank that stores the drain water collected through the drain passage, and an inlet port of the drain pump unit is connected to the drain tank.

Thereby, the collected drain water is stored in the drain tank without being brought to the electrical equipment, thus allowing the drain water to be reliably sucked by a drain pump.

The drain pan is integrally formed with the base panel, and the drain tank is provided beneath the drain pump unit placed on the side of the second side plate. Thereby, the drain passage and the drain tank are integrally formed with the base panel, thus allowing lower production costs in comparison with when they are separately formed, and allowing reliable control of a flow of the drain water.

A partition wall is provided between the drain passage and the drain tank, which are in communication with each other via a communication hole. Thereby, the drain water stored in the drain tank does not return to the drain passage, thus preventing the drain passage from being contaminated with dirty drain water.

A bottom of the drain tank is lower than the drain passage. Thereby, the drain water collected by the drain passage can be reliably stored in the drain tank.

The base panel further has a support plate that supports the drain pump unit, and the drain pump unit is cantilevered on the back of the base panel via the support plate. Thereby, the drain pump unit is cantilevered on the back of the base panel, thus offering higher assembly properties and maintenance properties.

The support plate is mounted to the second side plate. Thereby, the drain pump unit can be efficiently incorporated by being mounted via the second side plate, without increasing unnecessary mounting members.

The air conditioner further includes a first bracket mounted on the side of the support plate, and a second bracket mounted on the side of the drain pump unit, and the first bracket and the second bracket are connected via a vibration isolation member. Thereby, the pump unit is mounted to the support plate via the vibration isolating member, thus allowing vibration caused by the pump motor to be effectively absorbed by the vibration isolation member.

The support plate further has a guide plate for mounting the drain pump unit to the support plate via the first bracket, and the guide plate has a guide hole that receives a part of the vibration isolation member. Thereby, the first bracket is mounted along the guide plate provided on the support plate, thus allowing the pump unit to be easily positioned and secured.

The guide plate has a screw hole for securing the first bracket, and a screw is threaded into the screw hole to mount the drain pump unit to the body cabinet from the front. This offers good assembly properties and disassembly properties, and increases productivity.

A securing plate that holds a part of a pipe drawn from the drain pump unit stands on the first bracket, the securing plate has a drawing hole through which the drain pipe is drawn outwards, and the support plate also has a drawing hole in a position opposite the drawing hole. This allows the drain pipe from the drain pump unit to be properly placed, and allows simplification of a discharge passage outwards of the device.

DETAILED DESCRIPTION

Figure 1:
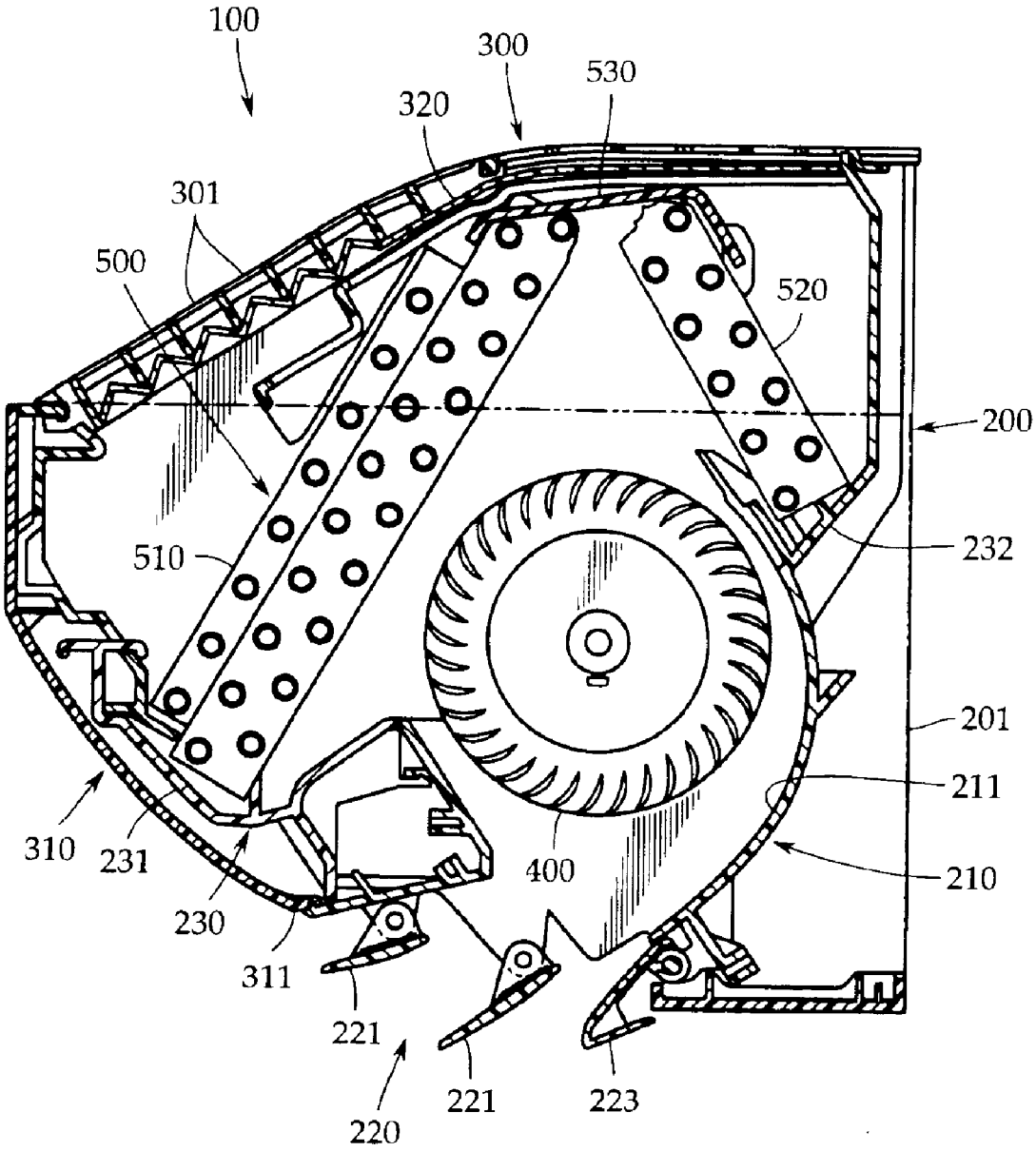
FIG. 1 is a schematic sectional view of an internal structure of an air conditioner according to the invention.

Now, an embodiment of the invention will be described with reference to the drawings. FIG. 1 is a schematic sectional view of an internal structure of an air conditioner according to an embodiment of the invention. The air conditioner (an indoor device) includes a body cabinet 100 mounted to an indoor wall surface via an unshown mounting fitting.

The body cabinet 100 includes a base panel 200 having a vertical mounting surface 201 held in a hung manner by a mounting fitting, a top panel 300 extending from a top edge of the base panel 200 toward a side opposite the wall surface, and a bottom panel 310 extending from a bottom edge of the base panel toward a tip of the base panel 200. The base panel 200, the top panel 300, and the bottom panel 310 are molded components made of resin.

The top panel 300 is a facing plate that covers an upper half from a top end of the base panel 200 as shown in FIG. 1, and has, along a front surface thereof, an air inlet 301 for taking indoor air into the body cabinet 100 in a grille shape. The air inlet 301 is formed in a surface opposite a fan housing portion 210 between side plates 250 and 260 (see FIG. 2).

A filter 320 for removing dust in the air is placed on the back of the top panel 300 (the side of the body cabinet 100). In this embodiment, the filter 320 is removably provided in the base panel 200. In the invention, any configuration of the top panel 300 can be selected.

The bottom panel 310 is a facing plate formed so as to be warped to cover a bottom end toward an upper portion of the base panel 200, and has a tip engaging a tip of the top panel 300.

The bottom panel 310 has an opening 311 for opening an air outlet 220 of the base panel 200 outwards. In the invention, any configuration of the bottom panel 310 can be selected.

The body cabinet 100 houses a cross flow fan 400 and a heat exchanger 500 or the like.

Figure 2:
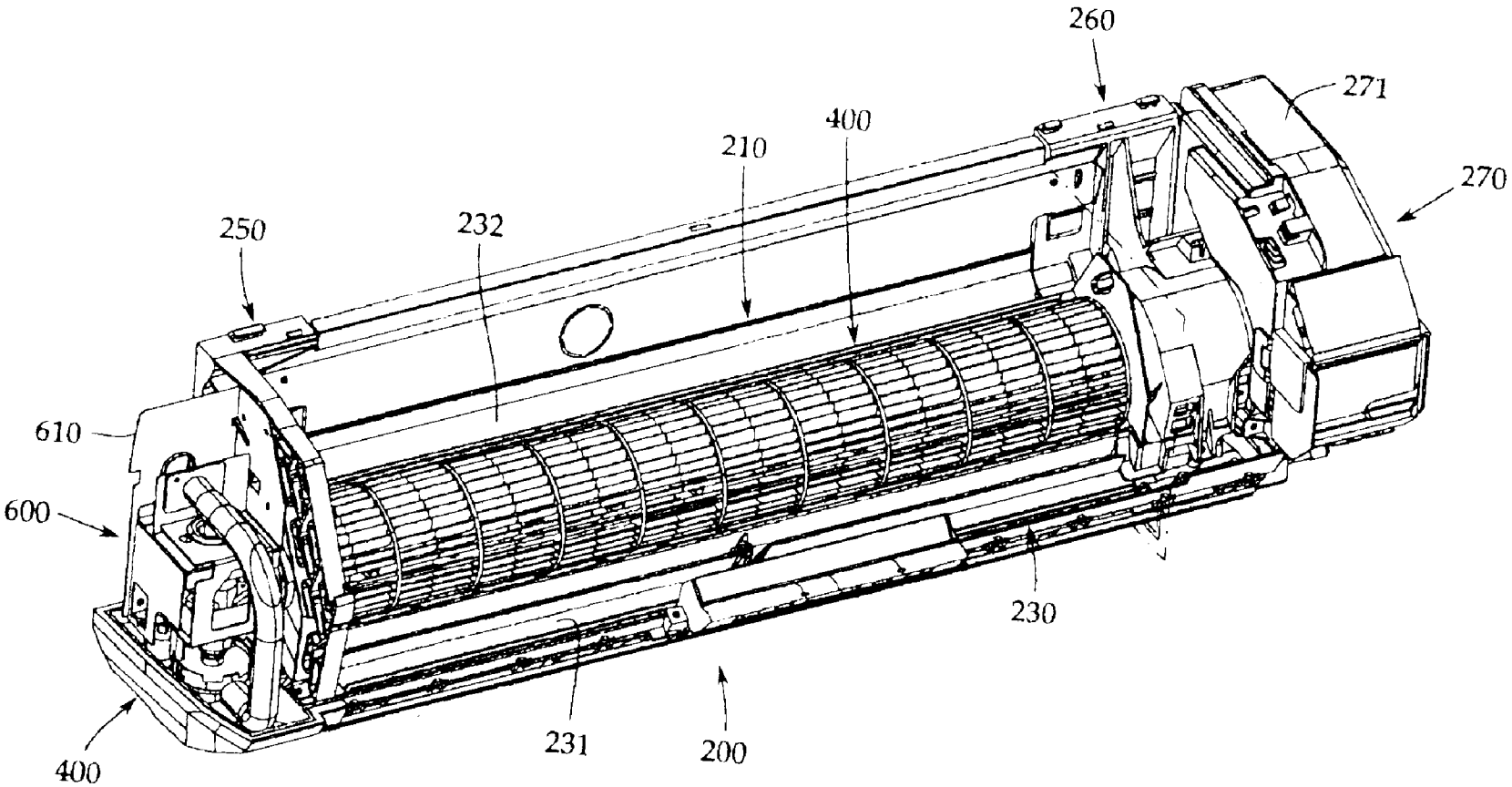
FIG. 2 is a perspective view of a state where a heat exchanger is removed from a base panel.
Figure 3:
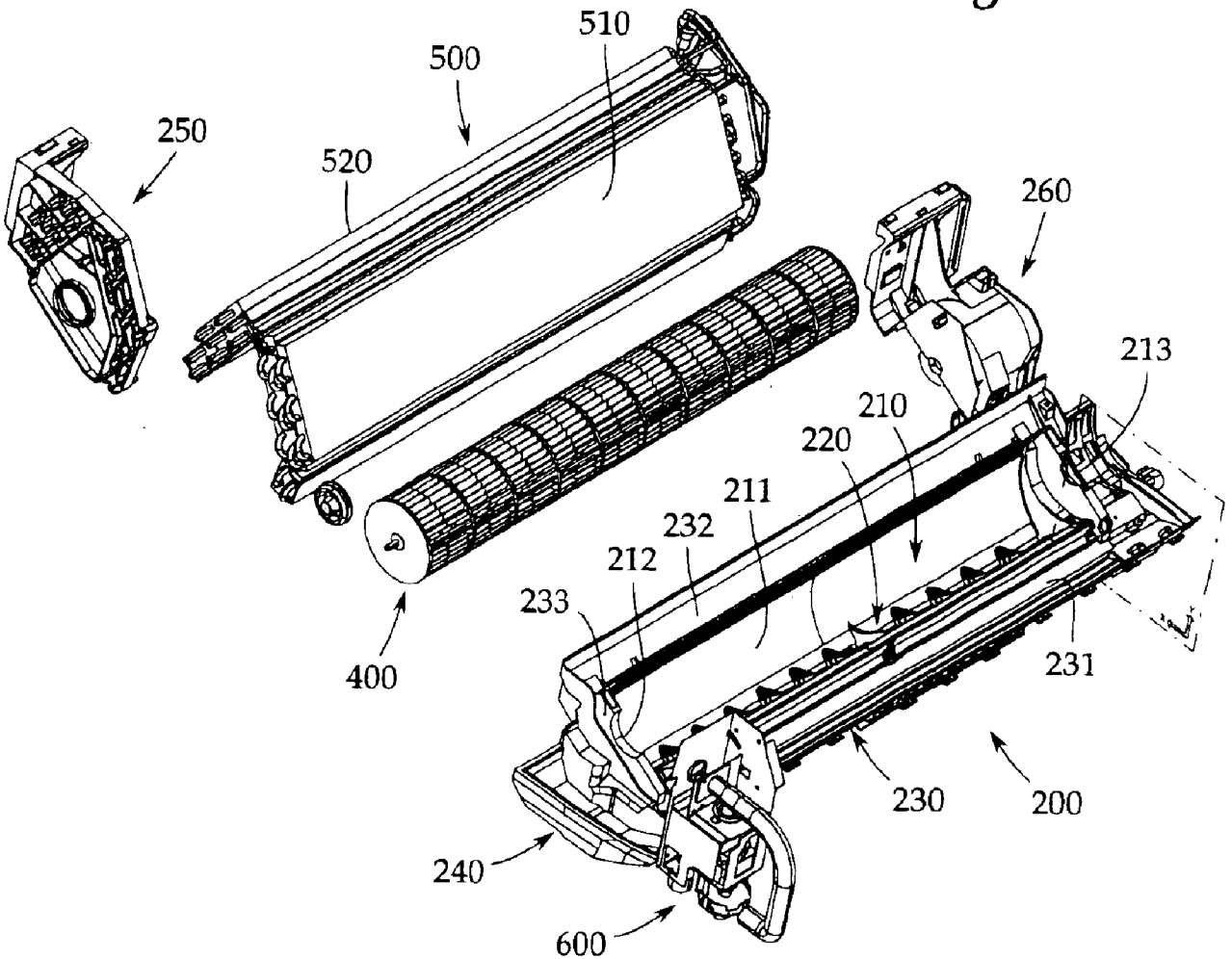
FIG. 3 is an exploded perspective view of a state where an internal structure of the base panel is disassembled.
Figure 4:
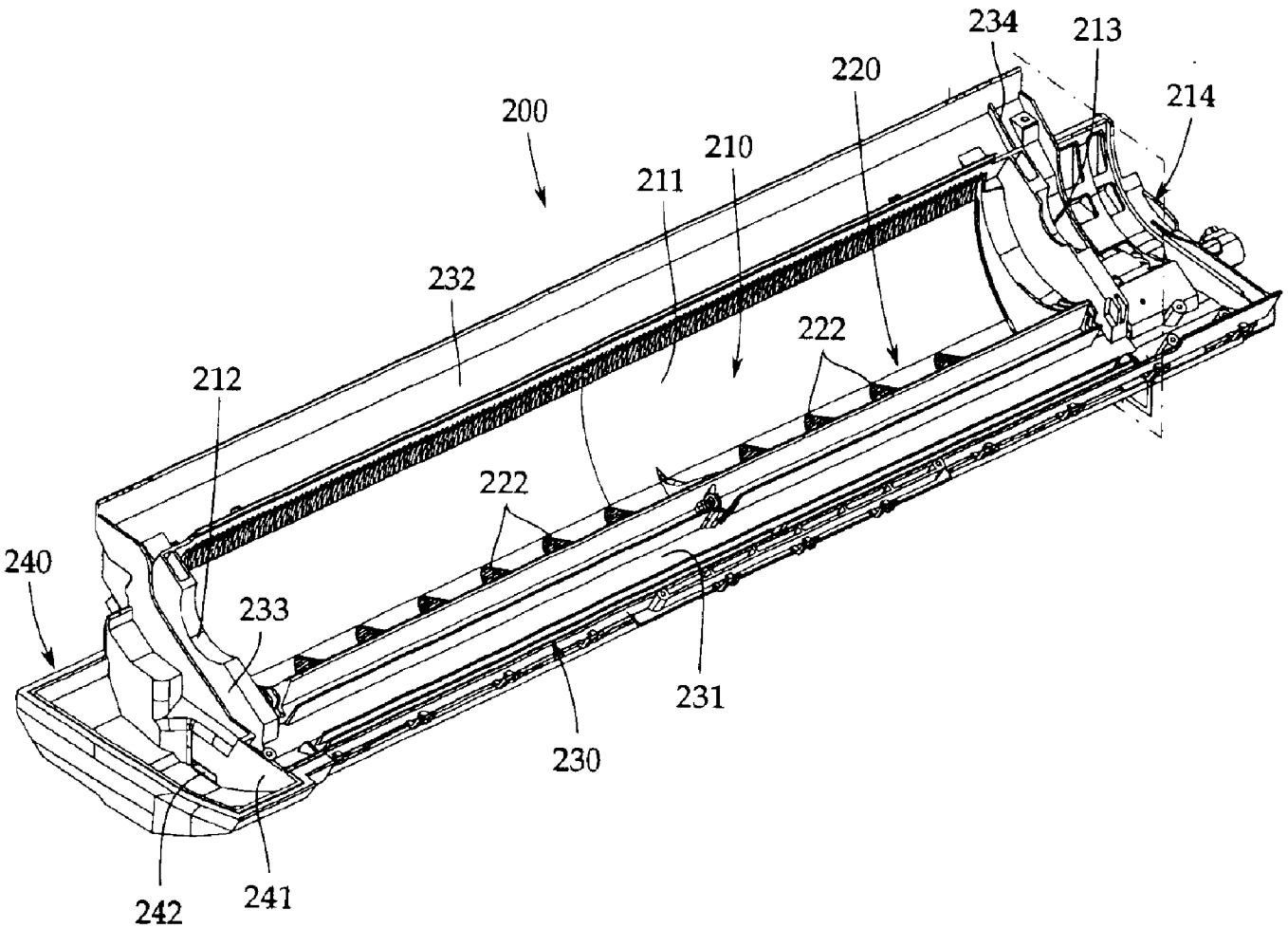
FIG. 4 is a perspective view of the base panel.

With reference to FIGS. 2 to 4, in the base panel 200, the fan housing portion 210 extends along the width thereof, on a center of which the cross flow fan 400 is hung. In the fan housing portion 210, a fan casing 211, which produces negative pressure to cause wind when the cross flow fan 400 is driven, is formed into an arcuate surface shape along an outer peripheral surface of the cross flow fan 400.

Fan mounting portions 212 and 213 for supporting the cross flow fan 400 are provided in both ends of the fan housing portion 210, and the cross flow fan 400 is bearing mounted, at both ends thereof, between the fan mounting portions 212 and 213 along and apart from the fan casing 211.

A motor resting portion 214 on which a fan motor (not shown) of the cross flow fan 400 is rested is formed on one fan mounting portion 213. The motor resting portion 214 is formed into an arc shape along an outer peripheral surface of the fan motor.

In the invention, the cross flow fan 400 and the fan motor thereof are arbitrary components, and conventional ones can be applied. Thus, detailed descriptions thereof will be omitted.

Also with reference to FIG. 1, the air outlet 220 for blowing the wind caused by the cross flow fan 400 out of the body cabinet 100 is provided in a lower central portion of the base panel 200.

The air outlet 220 extends along the fan housing portion 210, and near an outlet portion thereof, a vertical wind direction plate 221 that vertically divides airflow and a lateral wind direction plate 222 that laterally divides the airflow are provided. The wind direction plates 221 and 222 are pivoted on the base panel 220, and turn on a pivot by an unshown driving motor.

A diffuser 223 that changes a blowing direction of the air between in a cooling operation and in a warming operation is provided in the outlet portion of the air outlet 220. The diffuser 223 is also pivotably driven by the unshown driving motor, and has a maximum angle of aperture counterclockwise in a rapid operation.

A drain pan 230 that receives the drain water produced by a heat exchanger 500 is integrally formed with the base panel 200.

As shown in FIGS. 1 and 4, the drain pan 230 includes a front drain passage 231 that receives drain water produced by a front heat exchanger unit 510, and a back drain passage 232 that receives drain water produced by a back heat exchanger unit 520, and the drain passages 231 and 232 are formed symmetrically with respect to the fan housing portion 210.

The front drain passage 231 and the back drain passage 232 are in communication with each other via a side drain passage 233 formed on a side of the fan mounting portion 212, and the drain water collected by the back drain passage 232 flows into the left of the front drain passage 231 through the side drain passage 233.

In the embodiment, a waterproof rib 234 stands on the right (i.e. the side where an electrical equipment box is housed) of the back drain passage 232, and the waterproof rib 234 blocks the flow of the drain water into a space on the side of the electrical equipment box.

The base panel 200 also has a drain tank 240 that stores the drain water collected through the drain passages 231 to 233. The drain tank 240 is formed on the left of the fan mounting portion 212, and formed into a bath tab shape with an open top surface. The drain tank 240 is formed beneath a below described drain pump unit 600.

The drain tank 240 is separated from the front drain passage 231 by the partition wall 241, and in communication with the front drain passage 231 via a communication hole 242 formed in the partition wall 241. Thereby, the partition wall 241 is provided to prevent backflow of the drain water stored in the drain tank 240 to the front drain passage 231. This also prevents dust or the like floating on the drain water from returning to the front drain passage 231 through the communication hole 242.

A bottom of the drain tank 240 is preferably lower than a receiving surface of the front drain passage 231. A permissible water level surface of the drain tank 240 is preferably higher than that of the front drain passage 231.

This allows the drain water to reliably fall into the drain tank 240, and prevents an increase in water level of the drain tank 240 to causes leakage of the stored drain water, even if the front drain passage 231 is filled with the drain water.

After the cross flow fan 400 is mounted to the fan housing portion 210 of the base panel 200, the fan mounting portions 212 and 213 are covered with bearing covers 250 and 260. In the embodiment, the bearing cover 260 housing the motor also serves as a holding cover of the fan motor.

The bearing covers 250 and 260 are mounted to the fan mounting portions 212 and 213 to also function as the side plates 250 and 260 that partition a space in the body cabinet 100 with the cross flow fan 400 therebetween.

The heat exchanger 500 is rested on tops of the side plates 250 and 260 in a spanning manner. As shown in FIG. 1, the heat exchanger 500 includes two heat exchanger units 510 and 520 combined into a substantially lambda (Λ) shape, and is secured to the base panel 200 by a screw so as to cover the cross flow fan 400.

One heat exchanger unit 510 (the front heat exchanger unit) is placed in a forward slanting position from a top of the cross flow fan 400 toward the front drain passage 231. The other heat exchanger unit 520 is placed in a backward slanting position from the top of the cross flow fan 400 toward the back drain passage 232.

The heat exchanger units 510 and 520 are integrated via a connection plate 530 at the top.

As shown in FIG. 2, the drain pump unit 600 is placed on the side of one side plate 250 among the side plates interposing the cross flow fan 400. On the other hand, an electrical equipment box 270 is placed on the side of the other side plate 260. In the invention, the electrical equipment box 270 and the drain pump unit 600 are preferably placed opposite with the cross flow fan 400 therebetween.

Specifically, in order to avoid influences on the electrical equipment box 270 by the drain water produced by the heat exchanger 500 as much as possible, the electrical equipment box 270 and the pump unit 600 are preferably placed as far away as possible from each other.

The electrical equipment box 270 has a housing 271 made of resin, and is secured to the base panel 200 by a screw via the housing 271.

Figure 5:
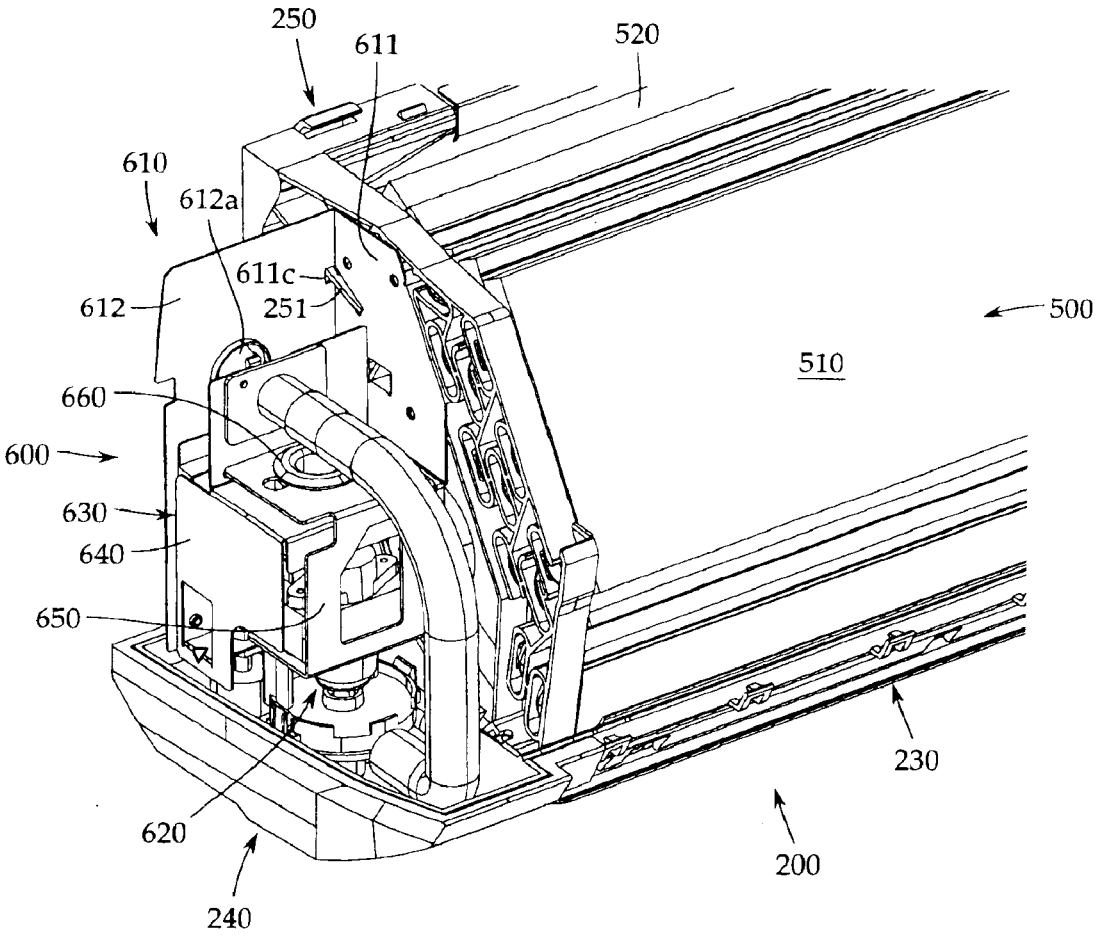
FIG. 5 is an enlarged perspective view of a state where a drain pump unit is mounted to the base panel.

As shown in FIG. 5, the drain pump unit 600 is secured to the side plate 250 of the base panel 200 (on the side opposite the electrical equipment box 270) via a support plate 610 in order to discharge the drain water stored in the drain tank 240 outwards.

Figure 6B:
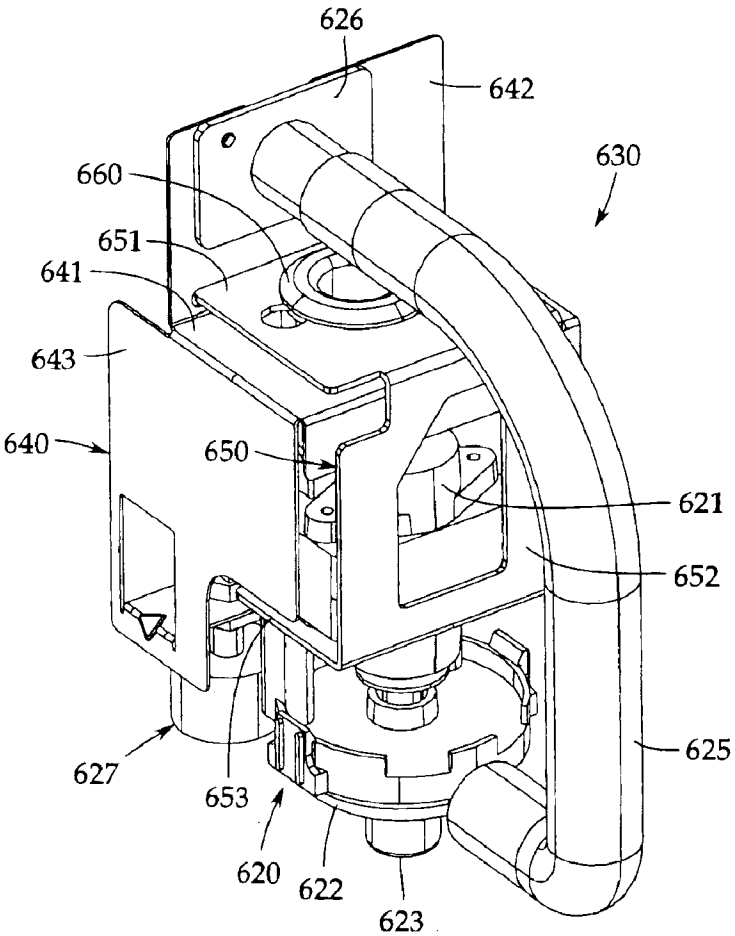
FIG. 6B is a perspective view of the drain pump unit.
Figure 6A:
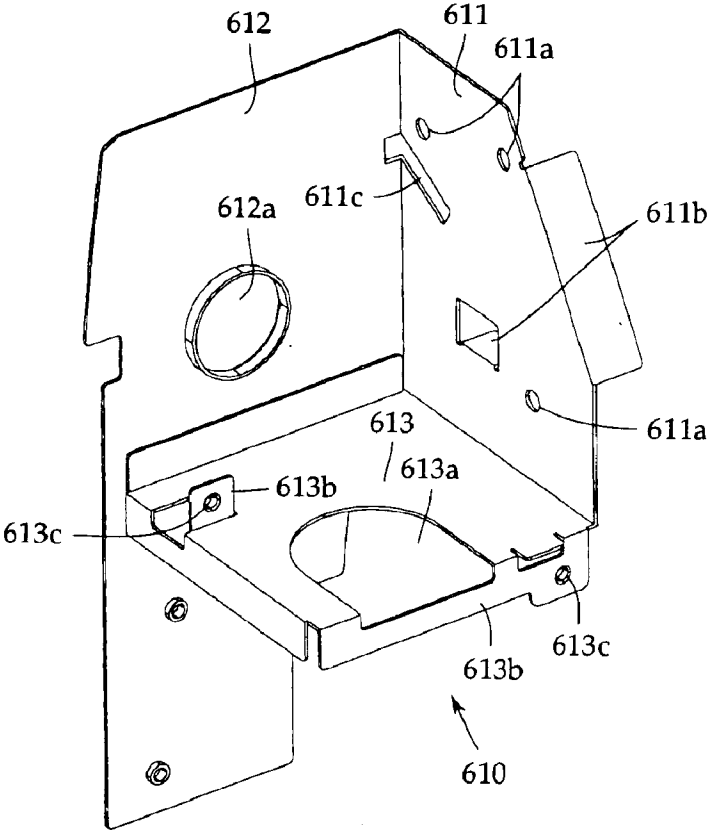
FIG. 6A is a perspective view of a support plate.

As shown in FIG. 6A, the support plate 610 includes a first support plate member 611 secured along the side plate 250, and a second support plate member 612 integrally formed with one end side (a wall surface side) of the first support plate member 611, and the first and the second support plate members 611 and 612 are formed of one metal plate substantially perpendicularly bent.

The first support plate member has a securing hole 611*a* secured to a screw hole (not shown) of the side plate 250 via a securing screw (not shown), and in this embodiment, has three securing holes 611*a*.

The first support plate member 611 has a tongue 611*b* hung on the side plate 250 for more stable securing to the side plate 250, and in this embodiment, has two tongues 611*b*. The tongue 611*b* is formed by substantially perpendicularly bending a part of the first support plate member 611 toward the side plate 250.

A guide slit 611*c* for guiding the support plate 610 to a proper securing position on the side plate 250 is formed on a joining portion between the first support plate member 611 and the second support plate member 612. The guide slit 611*c* is brought to fit over a guide rib 251 (see FIG. 5) provided on the side plate 250 to guide the support plate 610. In the embodiment, the guide slit 611*c* is formed in a slanting direction.

The second support plate member 612 vertically stands along the wall surface of the base panel 200, and has, in an upper central portion thereof, a drawing hole 612*a* through which a drain hose drawn from the drain pump unit 600 is drawn to the back of the base panel 200.

A bottom end of the second support plate member 612 extends to a top of the drain tank 240 of the base panel 200.

A third support plate member 613 substantially perpendicular to the wall surface (horizontal to a floor) is formed on the second support plate member 612. The third support plate member 613 is integrally formed with a bottom end of the first support plate member 611, and is bent substantially perpendicularly to an opposing surface between the first support plate member 611 and the second support plate member 612.

The third support plate member 613 has a guide hole 613*a* on which a part of a vibration insulation member 660 mounted to the drain pump unit 600 is rested. The guide hole 613*a* is formed by cutting out a portion from a front end to a center of the third support plate member 613 in an arch shape, and the center side is formed into an arc shape.

The third support plate member 613 has a flange 613*b* formed by substantially perpendicularly bending a part thereof, and in this embodiment, has two flanges 613*b*. The flanges 613*b* each have a screw hole 613*c* for securing the drain pump unit 600.

Next, with reference to FIGS. 6B and 7, a configuration of the drain pump unit 600 will be described. The drain pump unit 600 includes a pump 620 that discharges the drain water, and a bracket 630 for securing the pump 620 to the support plate 610.

The pump 620 has a driving motor 621 in an upper portion thereof, and an output shaft of the driving motor 621 is connected to a pump body 622 placed in a lower portion. An inlet port 623 to be inserted into the drain tank 240 is formed on a bottom of the pump body 622. An outlet port 624 is formed on a side of the pump body 622.

A drain hose 625 is inserted into the outlet port 624. The drain hose 625 is formed of a U-shaped rubber hose. The other end of the drain hose 625 is connected to a joint 626 to be connected to an unshown main line of the drain hose.

A cylindrical connecting portion 626*a*, into a center of which the drain hose 625 is inserted, stands on the joint 626. A connecting port (not shown) to which a drain hose placed on the back of the base panel 200 is connected is formed on the back of the joint 626 (the side opposite the cylindrical connecting portion 626*a*).

The pump 620 further has a float switch 627 connected to unshown control means. The float switch 627 is independently held inside the bracket 630, and a float 627*a* at a tip falls into the drain tank 240. When the drain water stored in the drain tank 240 reaches a predetermined level, the float switch 627 detects the amount of water by the float portion 627*a* floating, to send a detection signal to a control unit.

Figure 7:
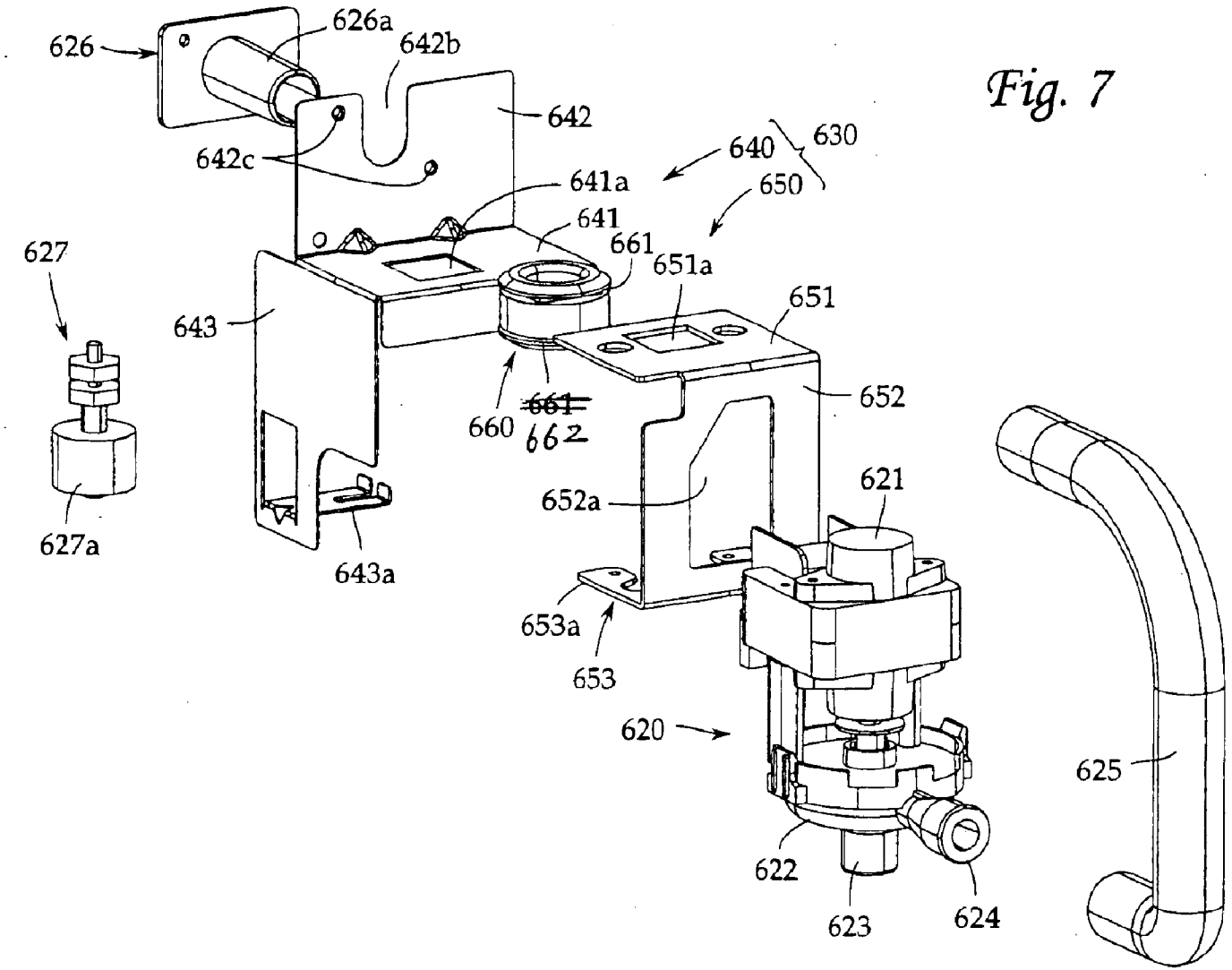
FIG. 7 is an exploded perspective view of the drain pump unit.

With reference to FIG. 7, the bracket 630 has a first bracket 640 secured to the support plate 610 and a second bracket 650 holding the pump 620, and they are connected via the vibration insulation member 660.

The first bracket 640 includes a first bracket plate 641 placed on the third support plate member 613 of the support plate 610, a second bracket plate 642 vertically standing from one end of the wall surface side of the first bracket plate 641, and a third bracket plate 643 hung from a left edge of the first bracket plate 641.

The first bracket plate 641 is a base plate horizontally formed along the third support plate member 613, and has, in a center thereof, a locking hole 641*a* into which one bushing 661 formed on the vibration insulation member 660 is locked.

The second bracket plate 642 is a securing plate that is placed parallel to the second support plate member 612 as shown in FIG. 5, and to which the joint 626 of the pump unit 600 is secured as shown in FIG. 6B.

The second bracket plate 642 has a notch 642*b* through which the connecting port on the back of the joint 626 is drawn. The notch 642*b* is formed into a U shape from an upper end of the second bracket plate 642. The second bracket plate 642 has a screw hole 642*c* for screw securing, and in the embodiment, has two screw holes 642*c* with the notch 642*b* therebetween.

The third bracket plate 643 is a protection plate that is placed parallel to the side plate 250 as shown in FIG. 5, and protects a side opposite the side plate 250 of the pump unit 630 as shown in FIG. 6B.

The third bracket plate 643 has a cut and raised piece 643*a* formed by cutting and raising a part thereof. The cut and raised piece 643*a* is substantially perpendicularly cut and raised from the third bracket plate 643 toward the side plate 250, and has two locking nails 643*b* at a tip thereof. The float switch 627 of the pump unit 630 is hung on the locking nails 643*b*.

Next, the second bracket 650 will be described. The second bracket 650 includes a fourth bracket plate 651 placed parallel to the first bracket plate 641 of the first bracket 640, a fifth bracket plate 652 hung from a front edge of the fourth bracket plate 651, and a sixth bracket plate 653 vertically formed from a bottom edge of the fifth bracket plate 652 toward the support plate 610.

For the second bracket 650, one metal plate is substantially perpendicularly bent along two phantom bending lines to provide a π-shaped section by the fourth to the sixth brackets 651 to 653.

As shown in FIG. 7, the fourth bracket plate 651 is a base plate that is placed parallel to the first bracket plate 641, and connected to the first bracket 640 via the vibration insulation member 660.

The fourth bracket plate 651 has, in a center thereof, a locking hole 651*a* into which the vibration insulation member 660 is fitted. The locking hole 651*a* is a square hole into which a bushing 662 of the vibration insulation member 660 is locked.

The fifth bracket plate 652 is a protection plate that is substantially perpendicularly bent from a front end of the fourth bracket plate 651, and protects the pump unit 630 therein from the front as shown in FIG. 6B. The fifth bracket plate 652 has an opening 652*a* for weight reduction and visual check of the inside.

The sixth bracket plate 653 is a support plate that is formed by substantially perpendicularly bending a bottom end of the fifth bracket plate 652 toward the support plate 610, and supports the pump unit 630.

The sixth bracket plate 653 has two opposing holding nails 653, and as shown in FIG. 6B, the pump motor 621 of the pump unit 630 is hung, at a lower side thereof, between the holding nails 653*a*.

As shown in FIG. 7, the vibration insulation member 660 is an elastic cylinder made of synthetic resin or rubber, and has, in a center thereof, an absorption hole 663 that absorbs deformation.

A bushing 661 to be locked into the locking hole 651*a* of the second bracket 650 is formed on the bottom end of the vibration insulation member 660. Likewise, the bushing 662 to be locked into the locking hole 641*a* of the first bracket 640 is formed on the top end of the vibration insulation member 660.

The bushings 661 and 662 are annular grooves formed inwardly from an outer periphery of the vibration insulation member 660, and the first bracket 640 and the second bracket 650 are held along and between the grooves to connect the brackets 640 and 650.

Next, an example of a mounting procedure for mounting the drain pump unit 600 to the base panel 200 will be described. First, the support plate 610 is mounted to the base panel 200.

When the support plate 610 is mounted, the guide slit 611*c* formed in the first support plate member 611 of the support plate 610 is brought to fit over the guide rib 251 provided on the side plate 250 to determine a position and an angle.

With this state kept, the screw (not shown) is threaded into the screw hole provided in the side plate 250 from the securing hole 611*a* of the first support plate member 611. Thereby, the support plate 610 is cantilevered on the side surface of the side plate 250.

Next, the pump unit 600 is mounted to the support plate 610. The pump unit 600 is in a state where the bracket 630 is in advance integrally assembled with the pump 620 as shown in FIG. 6B.

With reference to FIGS. 6A and 6B, when the pump unit 600 is mounted, the first bracket plate 641 of the first bracket 640 is slid, at a lower surface thereof, from the tip of the third support plate member 613 of the support plate 610, and the second bracket plate 642 abuts against the flange 613*b* cut and raised from the third support plate member 613.

In this abutting state, the screw hole 613*c* in the flange 613*b* and the screw hole in the second bracket plate 642 are secured by a screw (or a bolt and a nut). Further, the screw hole 613*c* in the flange 613*b* formed on the front end of the third support plate member 613 and an unshown screw hole formed in the front surface of the second bracket plate 642 are secured by a screw, and thus the pump unit 600 is cantilevered on the support plate 610.

Thereby, the pump unit 600 is held on the base panel 200 via the support plate 610 and the bracket 630, with higher vibration insulation properties.

After the pump unit 600 is mounted, the unshown main line of the drain hose is connected to the joint 626 through the drawing hole 612 of the support plate 610 to connect the drain hose and the pump unit 600.

The preferable embodiment of the invention has been described with reference to the attached drawings, but the invention is not limited to the embodiment. The technical scope of the invention includes various variations or modifications that could be made by those skilled in the art within the scope of the technical idea described in claims.

What is claimed is:

1. An air conditioner comprising:

a body cabinet that includes a base panel secured to an indoor wall surface via predetermined securing means, said base panel having first and second side plates that support a cross flow fan and a heat exchanger from both sides, and a support plate;

a drain pan that receives drain water produced by said heat exchanger;

a drain pump unit that discharges said drain water collected by said drain pan outwards of said body cabinet and is placed adjacent to said second side plate, said drain pump unit being supported by said support plate and cantilevered on a back of said base panel via said support plate; and an electrical equipment box including a control substrate placed adjacent to said first side plate of said base panel.

2. The air conditioner according to claim 1, wherein said drain pan has a drain passage formed into a trough shape along said heat exchanger, and a drain tank that stores said drain water collected through said drain passage, and an inlet port of said drain pump unit is connected to said drain tank.

3. The air conditioner according to claim 2, wherein said drain pan is integrally formed with said base panel, and said drain tank is provided beneath said drain pump unit placed on a side of said second side plate.

4. The air conditioner according to claim 2, wherein a partition wall is provided between said drain passage and said drain tank, which are in communication with each other via a communication hole.

5. The air conditioner according to claim 2, wherein a bottom of said drain tank is lower than said drain passage.

6. The air conditioner according to claim 1, wherein said support plate is mounted to said second side plate.

7. The air conditioner according to claim 1, further comprising a first bracket mounted on a side of said support plate, and a second bracket mounted on a side of said drain pump unit, wherein said first bracket and said second bracket are connected via a vibration isolation member.

8. The air conditioner according to claim 7, wherein said support plate further has a guide plate for mounting said drain pump unit to said support plate via said first bracket, and said guide plate has a guide hole that receives a part of said vibration isolation member.

9. The air conditioner according to claim 8, wherein said guide plate has a screw hole for securing said first bracket, and a screw is threaded into said screw hole to mount said drain pump unit to the body cabinet from a front.

10. The air conditioner according to claim 7, wherein a securing plate that holds a part of a pipe drawn from said drain pump unit stands on said first bracket, said securing plate has a drawing hole through which said drain pipe is drawn outwards, and said support plate also has a drawing hole in a position opposite said drawing hole.

* * * * *